United States Patent [19]

Lindsay

[11] 4,348,069

[45] Sep. 7, 1982

[54] CABINETS AND DOORS THEREFOR

[75] Inventor: John A. Lindsay, Invercargill, New Zealand

[73] Assignee: Lynwood Products Limited, Invercargill, New Zealand

[21] Appl. No.: 142,882

[22] Filed: Apr. 23, 1980

[30] Foreign Application Priority Data

Apr. 26, 1979 [NZ] New Zealand ..... 190289

[51] Int. Cl.[3] ..... A47B 81/00; E05F 1/08

[52] U.S. Cl. ..... 312/324; 312/325; 312/238; 403/166; 16/65; 16/80

[58] Field of Search ..... 312/324, 325, 326, 258, 312/259, 238; 16/80, 65; 403/166

[56] References Cited

U.S. PATENT DOCUMENTS

| | | | |
|---|---|---|---|
| 409,009 | 8/1889 | Buckmaster | 312/324 |
| 724,152 | 3/1903 | Anderson | 16/80 |
| 1,742,333 | 1/1930 | Walter | 312/326 |
| 2,127,980 | 8/1938 | Niemann | 403/166 |
| 2,187,109 | 1/1940 | Bernholtz | 16/80 |
| 2,570,747 | 10/1951 | Bailey | 312/238 |
| 2,598,814 | 6/1952 | McAfee | 312/324 |
| 2,693,401 | 11/1954 | Brown | 312/238 |
| 2,835,546 | 5/1958 | Rothschild | 312/324 |
| 3,075,819 | 1/1963 | Liegeon et al. | 312/325 |
| 3,086,630 | 4/1963 | Wolf | 312/324 |
| 3,214,787 | 11/1965 | Pierie | 16/65 |
| 3,895,849 | 7/1975 | Behr | 312/324 |
| 4,146,280 | 3/1979 | Crownhart | 312/238 |

*Primary Examiner*—Victor N. Sakran

*Attorney, Agent, or Firm*—Zarley, McKee, Thomte, Voorhees & Sease

[57] ABSTRACT

A door for a cupboard and more especially a corner cupboard comprising a planar closure member formed in two sections of different width with one hingedly connected to the other, a first of said section being adapted for hinged mounted to an aperture in which in use the closure member is to be located. In order to control throughout the opening and closing operations of the door the outer or second section an arm is provided. The arm is pivotally coupled adjacent to the free edge of the second section of the door this edge being opposite to the edge of second section which is hinged to the first section. The arm is adapted at its other end to be pivotally attached to a fixture from said aperture. The fixture is in a plane which is parallel to that of the aperture.

17 Claims, 7 Drawing Figures

CABINETS AND DOORS THEREFOR

This invention relates to a door and more particularly to a door for a cupboard.

In cupboard installations it is often found that the door of the cupboard opens into a confined area which either restricts the movement of the door or else results in the door, in its opened position, becoming an undesirable obstruction. Such a situation often exists in a corner cupboard such as to be found, for example, at the joint of cupboard units situated on adjoining walls which are at right angles. In many instances the area in the corner between the cupboard units is not utilised or else access to such area is restricted by virtue of the fact that the cupboard doors cannot be hung in such a way as to provide ready access.

One way in which this problem can be overcome is to employ a two panel door arrangement where the door is formed in two sections with one section pivotally hinged to the carcass or side of the opening and the second section hinged to the first section. There are many problems with such an arrangement. For example it is difficult to control the door during the entire opening and closing operation as the outer or second section tends to pivot about its hinge connection to the second door. Also difficulties arise in the latching of the door in its closed position. Usually it is necessary to latch the inner or first section followed by latching of the outer section.

In an effort to overcome these problems it has been proposed that a control arm be employed to control the door sections during the opening and closing operations. These control arms have largely been unsuccessful for a variety of reasons. For example one proposal is to have the arm coupled to the second section by being attached to the inner face thereof adjacent the hinge coupling the sections. Whilst a certain degree of control is achieved the arm does not help to overcome the problem of lack of any latching action of the door in the closed position. In fact to achieve any degree of control without restricting the amount of opening of the door the arm is of a complex construction and is thus prone to malfunction whilst also being expensive to produce.

A door comprising a planar closure member formed in two section, of different width with one hingedly connected to the other, a first of said sections being adapted for hinged mounting to an aperture in which in use the closure member is to be located, and the second of said sections being pivotally coupled adjacent the free edge thereof which is opposite to the edge hinged to said first section to an arm which is adapted at its other end to be pivotally attached to a fixture remote from said aperture, but in a plane which is parallel to that of said aperture.

The arm can be of a construction where it is of adjustable length, or where it is extensible in length. For example, the arm can be formed from two sections coupled end to end by a spring biassing means which permits the arm in use to be of extensible length. Alternatively, the arm can comprise an elongate member which is pivotally coupled at each end to a mounting member with the elongate member being attached by spring biassing means at one said end to a coupling member which is pivoted to said mounting member. In either arrangement the spring biassing means can be a spring extending between two fixtures.

In a preferred form, the door sections are each of rectangular shape with a longitudinal edge of the first section being hingedly coupled to the longitudinal edge of the second section. In a preferred form the width of the second section is greater than that of the first section. The pivot mounting at the other end of the arm is preferably at a point which is aligned with the axis of the hinge coupling of the the first and second door section when the closure member is in the closed position.

In a second broad aspect of the invention, there is provided a cupboard unit having an aperture and a door of the type specified above, the door being hingedly coupled to a vertical wall which defines one side of the aperture and the arm of the door pivotally attached to a wall remote from said aperture but in a plane which is parallel to that of the aperture.

According to a third broad aspect of the invention there is provided a cupboard unit having an opening formed of two adjacent apertures set at mutual right angles each aperture having a door of the type described above, each door being hingedly coupled to a vertical wall which defines one end of said opening, the arm of each door each being pivotally attached to a wall remote from the aperture in which said door is located.

To more fully describe the invention reference will be made to the accompanying drawings in which.

Figure 2:
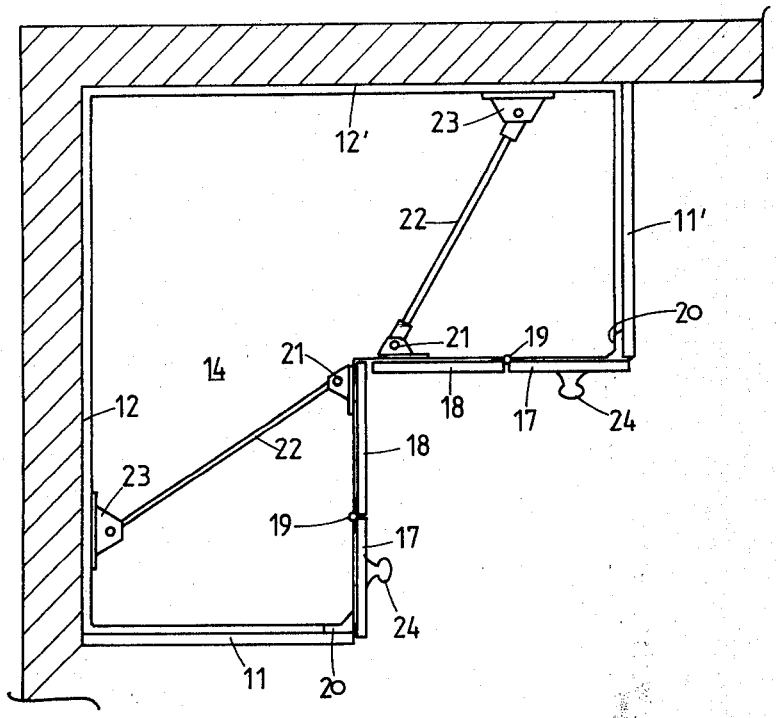
FIG. 2 is a plan view of the arrangement as shown in FIG. 1.
Figure 6:
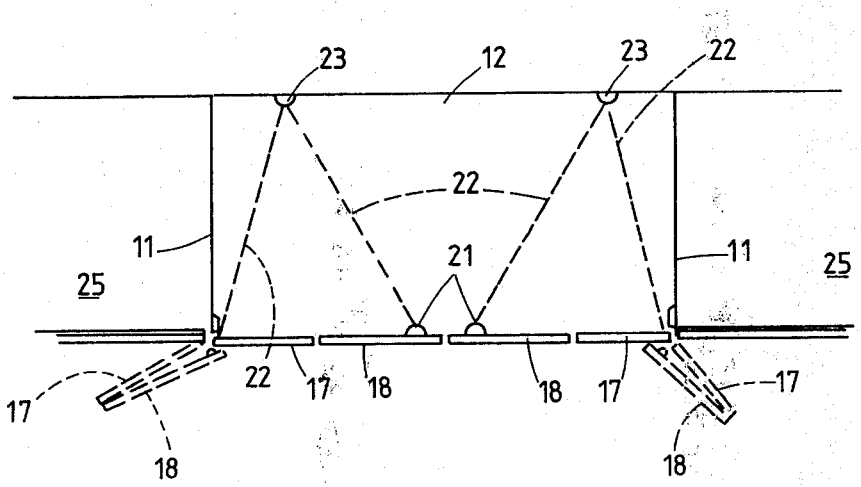
Figure 3:
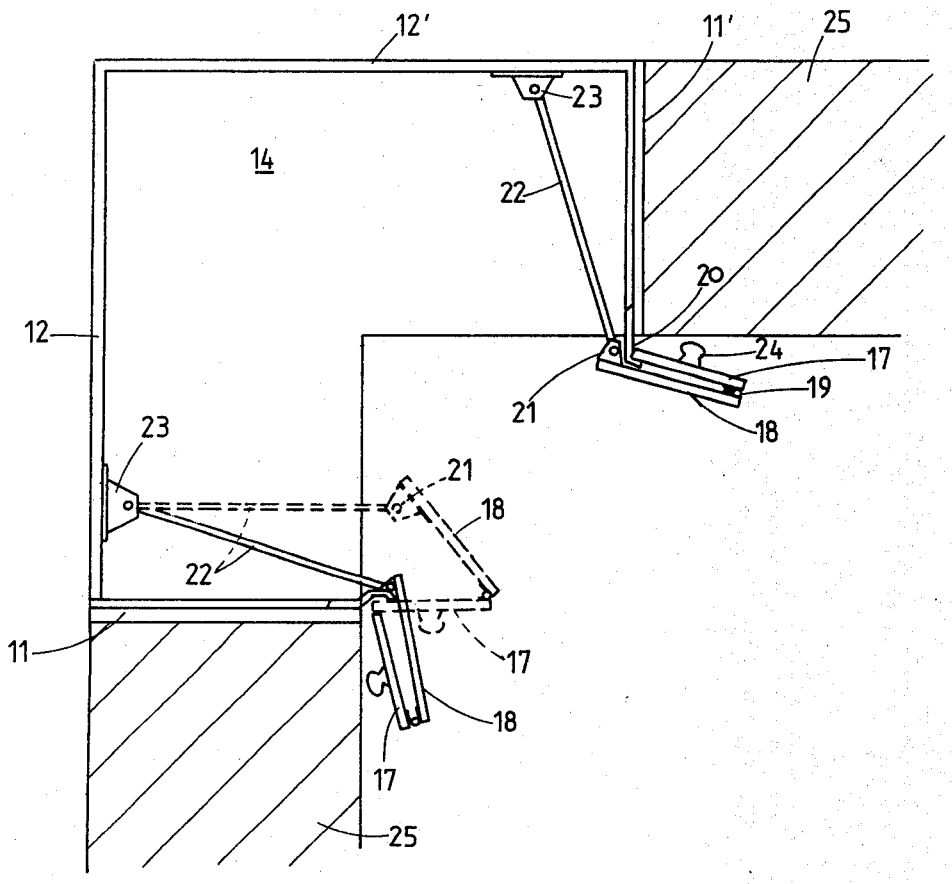
Figure 4:
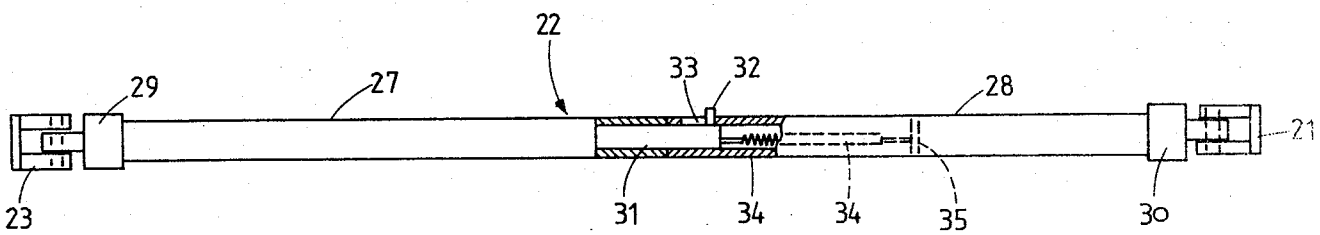
Figure 5:
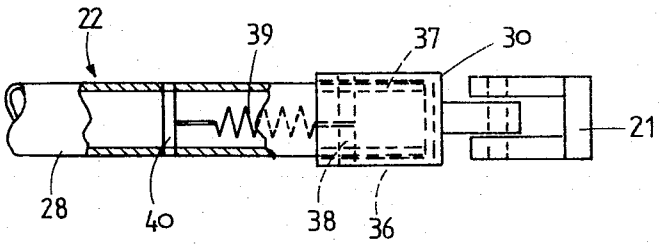
Figure 7:
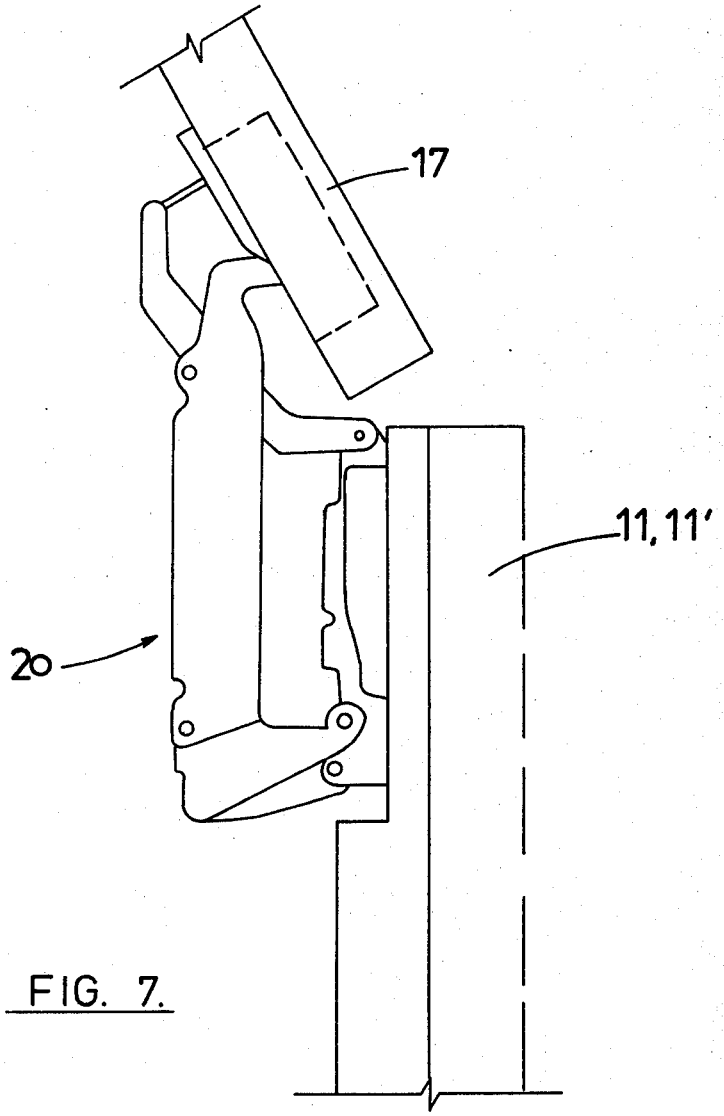

FIG. 3 is a plan view similar to FIG. 2 but showing the doors in the open and partially open positions, FIG. 4 is a partially sectioned view of a modified form of the invention when the arm is constructed of two sections, FIG. 5 is a part view partially sectioned of one end of the arm where it is coupled to a mounting unit, FIG. 6 is a schematic plan view of a further form of cupboard unit embodying the present invention, and FIG. 7 is a plan view of a hinge coupling the first door section to a fixture defining an edge of the aperture.

Figure 1:
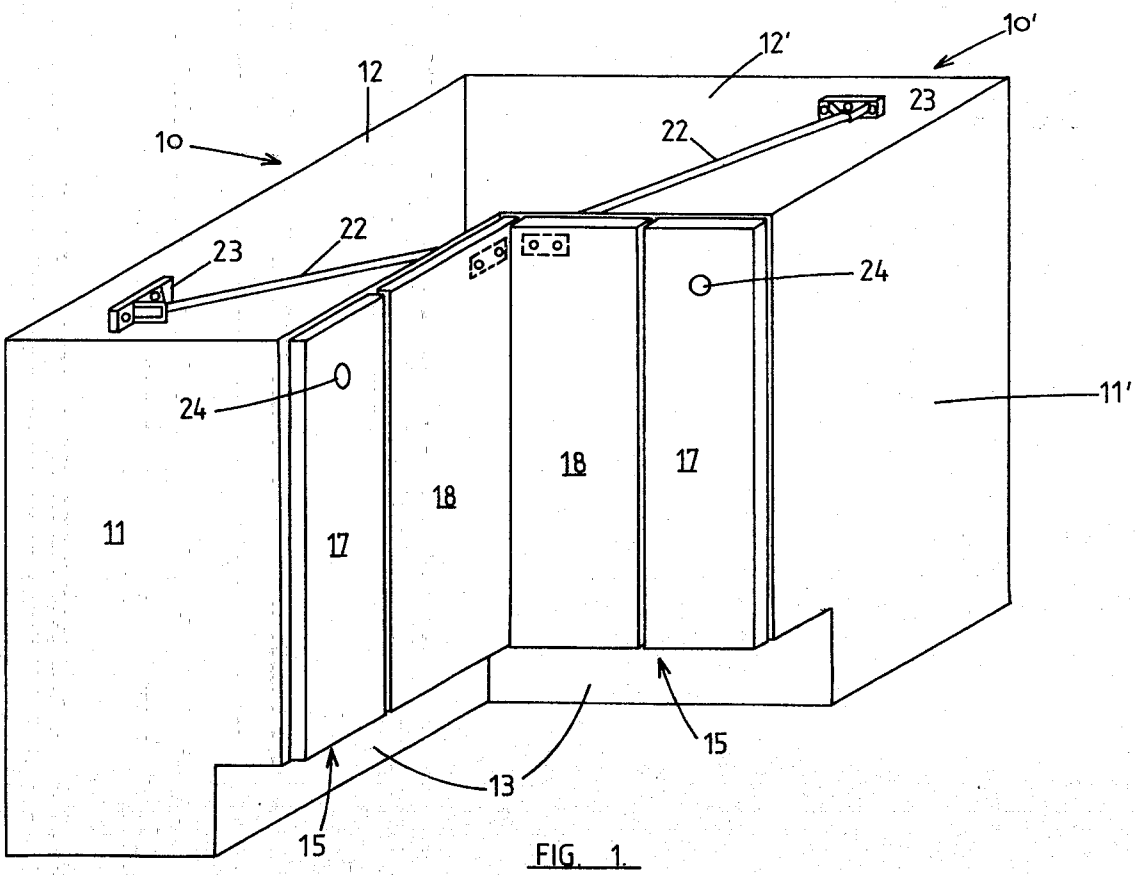
FIG. 1 is an isometric view of a cupboard unit with the doors closed.

Referring to FIG. 1, the cupboard unit as shown is a corner unit being composed of two sections 10 and 10' set at right angles to one another. Each section is defined by respectively side walls 11 and 11' and back walls 12 and 12'. Recessed kick boards 13 can be provided in the normal manner. In the drawings the top of the unit has been omitted in the interests of clarity whilst the floor 14 is shown in FIGS. 2 and 3.

In the drawings side walls 11 and 11' are shown as forming an integral part of the cupboard unit though it must be appreciated that such walls can be equally formed by the ends of adjoining cupboard units.

Each door 15 is located to close an aperture 16 and 16' of each section of the cupboard unit. Door 15 is composed of two substantially rectangular planar sections 17 and 18 which are hingedly joined along respective long sides by, for example, conventional butt hinges 19. The width of section 18 is greater than that of section 17 as can be clearly seen in the drawings.

Section 17 of each door 15 is hinged to the vertical end of respective side walls 11 and 11'. Hinges 20 on which sections 17 are hung are of a type which allow the vertical edge of the section 17 to move away and outwardly from the vertical end of wall 11 or 11'. The hinges 20 are also spring loaded. These types of hinges (an example of which is illustrated in FIG. 7) are well known in the art and operate so as to not only move the inner edge of the door section away (during opening) from the edge of the aperture but also latch the door closed when it is positioned within or covering the aperture.

A bracket 21 is fixed to the inner surface of each door section 18 near its upper edge at or adjacent the free vertical edge thereof. An arm 22, which is preferably of adjustable length, is pivotally coupled to bracket 21. The other end of arm 22 is pivotally coupled to a bracket 23 which is fastened to the respective back wall 12 and 12'. Bracket 23 is located on the same level as bracket 21 and preferably spaced a distance away from the adjacent side wall 11 and 11' so that it substantially aligned with the axis of hinge 19.

A handle, knob or like door pull is attached to one or both of door sections 17 and 18. In the illustrated form a pull 24 is mounted on each door section 17.

In use the corner cupboard unit is placed in position say between adjoining units 25. The doors 15 are hung as shown with the length of each arm 22 adjusted in length to allow the doors to close as shown in FIGS. 1 and 2. To open the door a person pulls on door pull 24 which causes section 17 to pivot about hinges 20. Due to the presence of arm 22 door section 18 pivots about the hinges 19 so that the door sections 17 and 18 hinge back on each other as shown in the lower door of FIG. 3 until the fully open positions are reached. The doors are closed in the reverse manner and the inner section 17 is spring shut near the end of travel due to the spring loading of hinges 20.

Throughout the opening and closing operations the action of the door is controlled by the arm 22 which ensures that the free end of door section 18 is correctly guided. The inner section 17 thus opens about hinges 20 with the outer section 18 hinging about hinges 19 due to the control of the free end of this section by arm 22. Latching of outer section 18 when in position within the aperture is not required as the arm 22 automatically effects latching when the door is closed due to the relative positions of the pivot axes of the ends of arm 22 and hinges 19 and 20. In the same manner the door is held in the fully open position by the arm 22 (see right hand side of FIG. 3).

In an alternative form of the invention, (see FIG. 4) the arm 22 is of tubular construction and in two sections 27 and 28 with the end of one section inserted in a socket coupling 29 which is pivoted to, for example, bracket 23 and the end of the other section 28 being inserted in a socket coupling 30 which is pivoted to the other bracket i.e., bracket 21. Arm sections 27 and 28 are joined end to end by a short tubular or cylindrical insert 31 which is fixedly attached within section 27 and slidably located within the open end of section 28. The extent of sliding movement within the end of section 28 is limited by a pin or the like projection 32 which extends transversely from insert 31 and is located within an elongate slot 33 in the wall of arm 28. A spring 34 is attached to the end of insert 31 and extends along the inside of section 28 to a fixture 35. Accordingly, the two sections of the arm can be moved away from one another but always return to the illustrated position under the biassing influence of spring 34.

A further form of the invention is illustrated in FIG. 5, where once again the arm 22 is of tubular construction but this time of a single length. As with the arrangement illustrated in FIG. 4, each end of the arm is located in a socket coupling which is pivoted to the respective brackets 21 and 23. In the arrangement illustrated in FIG. 4, one end of the arm is provided with a pair of elongated slots with one slot 36 being open ended and the other slot 37 closed at each end. A pin 38 extending through the socket coupling 30 passes through slots 36 and 37. A spring 39 located within arm 22 is attached by one end to pin 38 and at its other end to a fixture 40. Accordingly, under the influence of spring 39, the arm takes up the position within the socket coupling 30 as shown in FIG. 5, but is capable of a restricted amount of sliding movement within the socket coupling 30. The amount of movement is limited by the pin 38 engaged in the closed ended slot 37.

The arrangements illustrated in FIGS. 4 and 5 allow the arm to be extensible and thus take up any misalignment of the arm when mounted between the back wall and door as well as to relieve any stresses which may occur during the opening and closing of the door or due to misalignment of mounting. Of the two constructions, the construction illustrated in FIG. 5 is the simpler, and has the advantage that sagging which can occur with the arrangement shown in FIG. 4 is obviated.

Other constructions will be evident to those skilled in the art whereby the arm can be extensible to relieve stresses and take up any misalignment due to incorrect mounting.

The invention thus provides a door which when open is compact and can thus be opened in a confined space and does not constitute an obstruction. As described the door is particularly useful for corner cupboard units but of course is not solely limited to use with only corner cupboard units. For example a "straight" cupboard arrangement embodying the invention is illustrated in FIG. 6. The arms 22 control the opening and closing operations so that the door sections 17 and 18 hinge and fold in the stabilised manner previously described. Either set of doors may be opened and closed independently of the other in any order without causing the user to step out of the way of the path of the partially opened doors.

I claim:

1. In a cupboard having an opening defined at least in part by two lateral parallel walls a door for closing the opening said door comprising a planar closure member having one edge hingedly mounted to one of said lateral walls and a second edge which is parallel to said first edge engageable with the other lateral wall when said closure member is in the closed position, the closure member being formed in two sections of different width, said sections being hingedly interconnected along adjacent edges which are parallel to said first and second edge so that said two sections fold back parallel to and against one another when the closure member is in the fully opened position, said closure member in said fully open position being located outside said cupboard with the said second edge adjacent the edge of the lateral wall to which said first edge is hingedly connected, and an arm pivotally mounted by one end to said closure member adjacent said second edge and at its other end to a fixture remote from said opening but in a plane parallel to that of said opening.

2. A door as claimed in claim 1 wherein each said closure member section is of rectangular shape with the width of the section hingedly connected to the lateral wall being less than that of the other section.

3. A door as claimed in claim 1 or 2, wherein the pivot mounting of said other end of the arm is at a point which is aligned with the axis of the hinged interconnection of the two closure member sections when the closure member is in the closed position.

4. A door as claimed in claim 3 wherein the closure member is hinged to the lateral wall by hinges which are of a type which latch closed when the closure member section mounted thereby is located in the closed position.

5. A door as claimed in claim 3, wherein the arm is of adjustable length.

6. A door as claimed in claim 3, wherein the arm is extensible in length.

7. A door as claimed in claim 6, wherein the arm is formed from two sections coupled end to end by spring biassing means which permit in use the arm to be extensible in length.

8. A door as claimed in claim 7, wherein each arm section is tubular with the end of one arm section having a projection which locks within the end of the second arm section, said projection being mounted for restricted sliding movement within said second arm section and coupled to one end of a spring which lies within said second section and is anchored by its other end to a fixture in the length of said second arm section.

9. A door as claimed in claim 8, wherein each end of said arm is mounted in a socket coupling which is pivotally attached to a mounting therefor.

10. A door as claimed in claim 8, wherein said arm is tubular with each end fitted into a socket coupling member which is pivotally coupled to a said mounting member, the spring biasing means being a spring located with said arm and anchored between a fixture in said arm and a fixture with said coupling socket, the said one end of the arm being mounted for restricted longitudinal movement within said socket coupling in which it is inserted.

11. A door as claimed in claim 16, wherein said arm is pivotally coupled at each end to a mounting member said arm being attached by spring biassing means at one said end to a coupling member which is pivoted to said mounting member.

12. A cupboard having an opening defined at least in part by two lateral walls located at right angles to one another a pair of doors each comprising a planar closure member having one edge hingedly mounted to a said lateral wall, said doors when in the closed position being located at right angles to one another with their edges which are parallel to the hinged edge thereof located adjacent each other, each closure member being formed by two sections of different width, said sections being hingedly interconnected along adjacent edges so as to fold back parallel to and against one another when in the fully open position with said door in said open position located outside said cupboard with the said other edge adjacent the edge of the lateral wall to which the door is hingedly connected, and an arm pivotally mounted by one end to said door adjacent said other edge and at its other end to a fixture which is situated in a plane which is remote from but parallel to the plane in which said door is located in its closed position.

13. The invention as claimed in claim 12, wherein the pivot mounting of said other end of each arm is at a point which is aligned with the axis of the hinged interconnection of the two closure member sections when the closure member is in the closed position.

14. The invention as claimed in claim 13, wherein the arm is adjustable in length.

15. The invention as claimed in claim 13, wherein the arm is extensible in length.

16. The invention as claimed in claim 12, wherein each said closure member section is of rectangular shape with the width of the section hingedly connected to the lateral wall being less than that of the other section.

17. The invention as claimed in claim 13, wherein said arm is pivotally coupled at each end to a mounting member, said arm being attached by spring biasing means one said end to a coupling member which is pivoted to said mounting member, each said arm being tubular with each and thereof fitted into a socked coupling member which is pivotally coupled to said mounting member, the spring biasing means being a spring located within said arm and anchored between a fixture in said arm and a fixture with said coupling socket, the said one end of the arm being mounted for restricted longitudinal movement within said socket coupling in which it is inserted.

* * * * *